US012538955B2

(12) United States Patent
Li et al.

(10) Patent No.: US 12,538,955 B2
(45) Date of Patent: Feb. 3, 2026

(54) FALSE EYELASH WITH MULTIPLE STALKS ON THE SAME SIDE

(71) Applicant: Qingdao Baisi Yijia Cosmetic Products Co., Ltd, Qingdao (CN)

(72) Inventors: Kexiu Li, Qingdao (CN); Zhaozhong Zhang, Qingdao (CN)

(73) Assignee: Qingdao Baisi Yijia Cosmetic Products Co., Ltd, Qingdao (CN)

( * ) Notice: Subject to any disclaimer, the term of this patent is extended or adjusted under 35 U.S.C. 154(b) by 177 days.

(21) Appl. No.: 18/412,849

(22) Filed: Jan. 15, 2024

(65) Prior Publication Data

US 2024/0415219 A1 Dec. 19, 2024

(30) Foreign Application Priority Data

Jun. 16, 2023 (CN) ..... 202321556655.8

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS

2018/0228237 A1* 8/2018 Zhang ..... H01F 7/0215
2021/0352987 A1* 11/2021 Guan ..... C09J 143/04

FOREIGN PATENT DOCUMENTS

CN 212877782 U 4/2021
CN 217242848 U 8/2022

* cited by examiner

*Primary Examiner* — Rachel R Steitz

(57) ABSTRACT

A false eyelash with multiple stalks on the same side comprises a false eyelash body and an eyelash stalk, a root of the false eyelash body is adhered to the eyelash stalk by glue, the eyelash stalk comprises a strip-shaped stalk body, a magnetic block is magnetically connected with a magnetic strip on an adhesion seat, and a water-dipping glue layer is arranged on a back face of the adhesion seat. The eyelash stalk is arranged at the root of the false eyelash; when the false eyelash is adhered to an eyeliner part, two adhesion lines are provided; and the eyelash stalk is divided into two the strip-shaped stalk body and the adhesion seat, and when the false eyelash is worn, the adhesion seat is fixed to the eyeliner part first, and the strip-shaped stalk body is connected to the adhesion seat to realize stable wearing of the false eyelash.

2 Claims, 4 Drawing Sheets

FALSE EYELASH WITH MULTIPLE STALKS ON THE SAME SIDE

CROSS REFERENCE TO RELATED APPLICATIONS

This application claims foreign priority of Chinese Patent Application No. 202321556655. 8, filed on Jun. 16, 2023 in the China National Intellectual Property Administration, the disclosures of all of which are hereby incorporated by reference.

TECHNICAL FIELD

The application relates to the technical field of cosmetics, and is particularly a false eyelash with multiple stalks on the same side.

BACKGROUND OF THE PRESENT INVENTION

Many women will thicken and densify eyelashes to make eyes look more radiant, and the eyelashes are generally thickened and densified by adhering false eyelashes or applying mascara. Because applying mascara can only achieve a thickening effect, while adhering false eyelashes can achieve thickening and densifying effects at the same time, the false eyelashes are welcomed by many women.

However, in a use process of a traditional false eyelash, because an adhesion sheet cannot be disassembled from the false eyelash, when an adhesion force of the adhesion sheet affects normal wearing and use, the adhesion sheet cannot be replaced separately, so that it is necessary to replace the false eyelash as a whole, which increases a use cost of the false eyelash.

SUMMARY OF THE PRESENT INVENTION

(I) Solved Technical Problem

Aiming at the defects in the prior art, the application provides a false eyelash with multiple stalks on the same side, which solves the problem that, in a use process of a traditional false eyelash, because an adhesion sheet can not be disassembled from the false eyelash, when an adhesion force of the adhesion sheet affects normal wearing and use, the adhesion sheet can not be replaced separately, so that it is necessary to replace the false eyelash as a whole, which increases a use cost of the false eyelash.

(II) Technical Solution

In order to achieve the above object, the following technical solution is specifically used in the application.

A false eyelash with multiple stalks on the same side comprises a false eyelash body and an eyelash stalk, wherein the eyelash stalk is arc-shaped, a root of the false eyelash body is adhered to the eyelash stalk by glue, the eyelash stalk comprises a strip-shaped stalk body adhered to the false eyelash body, a magnetic block adhered to the strip-shaped stalk body is magnetically connected with a magnetic strip on an adhesion seat, and a water-dipping glue layer is arranged on a back face of the adhesion seat.

Further, the magnetic blocks are fixedly adhered to the strip-shaped stalk body and distributed at equal intervals, the magnetic block is matched with the magnetic strip, the magnetic strip is embedded in an arc-shaped groove formed in the adhesion seat, and the magnetic strip is arc-shaped and matched with the strip-shaped stalk body. An adhesion glue tape is coated in a recess formed in the back face of the adhesion seat, and the water-dipping glue layer is fixedly connected to the adhesion seat through the adhesion glue tape.

Further, the root of the false eyelash body is adhered to two eyelash stalks which are parallel to each other and arranged closely.

(III) Beneficial Effects

Compared with the prior art, the application provides the false eyelash with multiple stalks on the same side, which has the following beneficial effects:

in the application, two false eyelash stalks are arranged at the root of the false eyelash, so that it is convenient to provide two fixing bands, a fixing strength of the false eyelash is improved, and the false eyelash is prevented from falling off during use, thus achieving the purpose of stable use; when the false eyelash is adhered to an eyeliner part, two adhesion lines are provided, so that the false eyelash is stably adhered and worn, and a connecting strength is improved; and meanwhile, the eyelash stalk is divided into two the strip-shaped stalk body and the adhesion seat, the adhesion seat may be flexibly replaced according to an actual use requirement, and when the false eyelash is worn, the adhesion seat is fixed to the eyeliner part first, and then the strip-shaped stalk body is connected to the adhesion seat to realize stable wearing of the false eyelash, so that an operation is simple and convenient, and an eyelash shape is avoided from being damaged.

Figure 1:
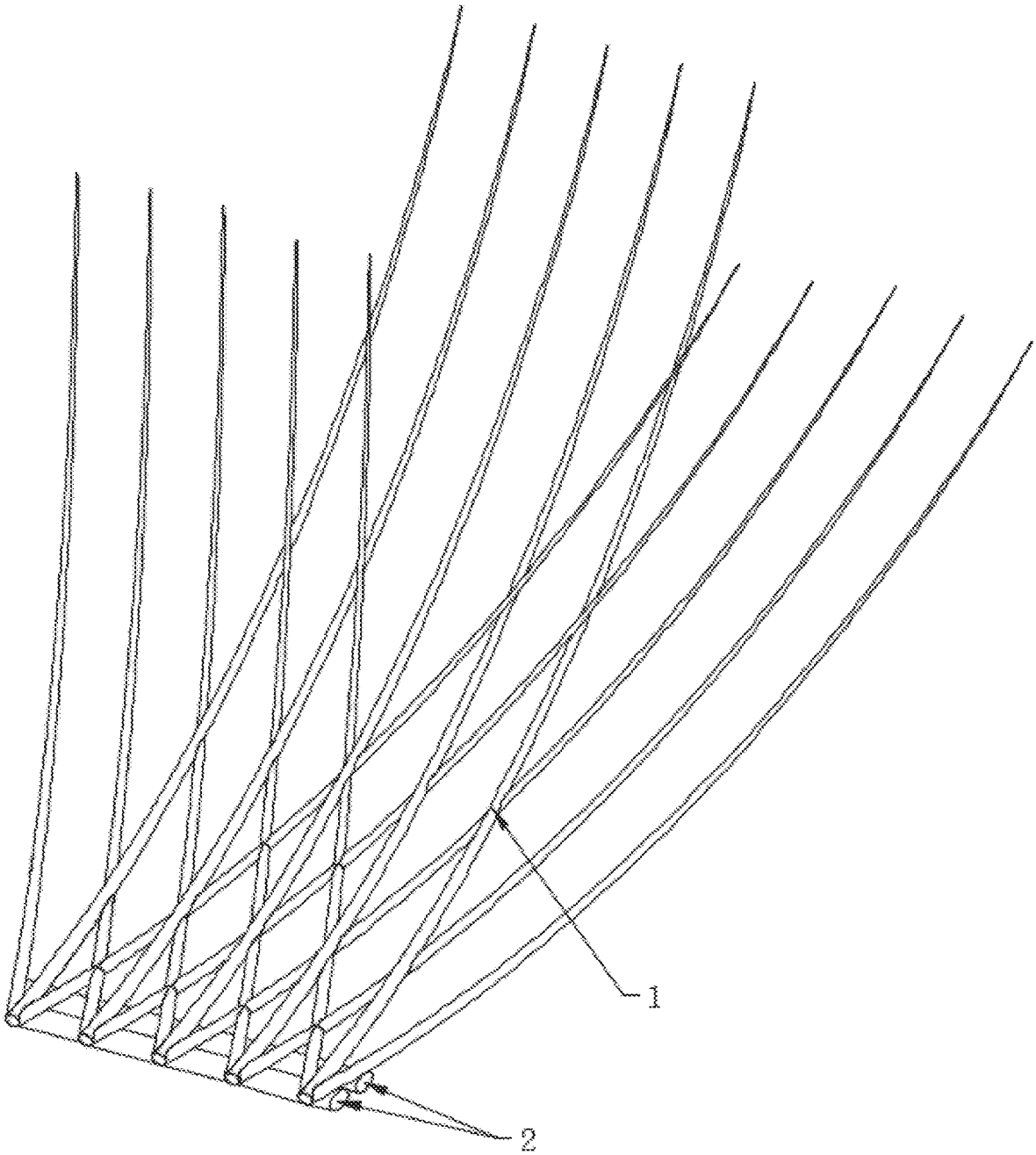
FIG. 1 is a schematic structural diagram of First Embodiment of the application.

In the drawings, 1 refers to false eyelash; 2 refers to eyelash stalk; 201 refers to strip-shaped stalk body; 202 refers to magnetic block; 203 refers to adhesion seat; 204 refers to magnetic strip; 205 refers to water-dipping glue layer; and 206 refers to adhesion glue tape.

DETAILED DESCRIPTION OF PREFERRED EMBODIMENTS

Technical solutions in embodiments of the application will be clearly and completely described hereinafter with reference to the drawings in the embodiments of the application. Obviously, the described embodiments are only some but not all of the embodiments of the application. Based on the embodiments of the application, all other embodiments obtained by those of ordinary skills in the art without going through any creative work fall within the scope of protection of the application.

First Embodiment

Figure 2:
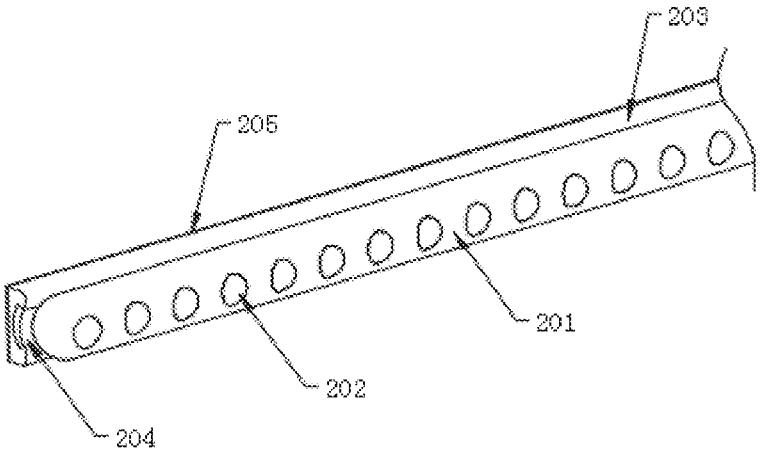
FIG. 2 is a schematic structural diagram of an eyelash stalk in First Embodiment of the application.
Figure 3:
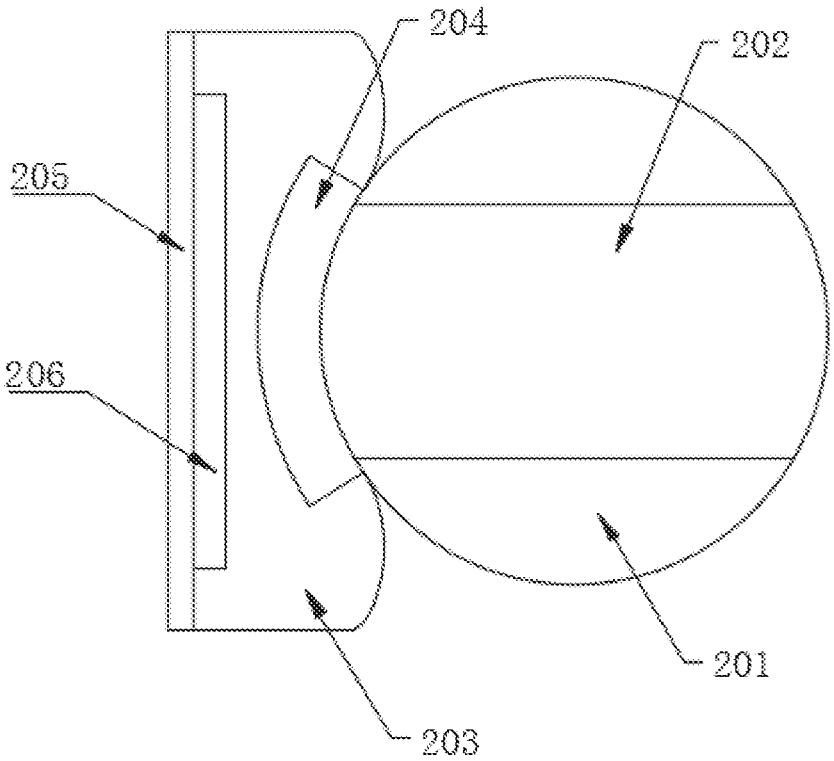
FIG. 3 is a sectional view of the eyelash stalk in First Embodiment of the application.

As shown in FIG. 1, FIG. 2 and FIG. 3, one embodiment of the application provides a false eyelash with multiple stalks on the same side, which comprises a false eyelash body 1 and an eyelash stalk 2. The eyelash stalk 2 is arc-shaped as a whole, which is convenient to better fit an eyeliner part of a user, so that the false eyelash may be adhered and fixed more stably, thus achieving the purpose of stable use. A root of the false eyelash body 1 is adhered to the eyelash stalk 2 by glue, and the root of the false eyelash body 1 is adhered to two eyelash stalks 2 which are parallel to each other and arranged closely, so as to ensure stable connection between the false eyelash body and the eyelash stalk, so that the false eyelash is orderly arranged on the eyelash stalk 2 to ensure stable use, and the false eyelash may be stably fixed to the eyeliner part through the eyelash stalk 2 at the same time, thus achieving the purpose of stable wearing and use. The two eyelash stalks 2 arranged are convenient to provide two fixing bands, so that a fixing strength of the false eyelash is improved, and the false eyelash is prevented from falling off during use, thus achieving the purpose of stable use. When the false eyelash is adhered to the eyeliner part, two adhesion lines are provided, so that the false eyelash is stably adhered and worn, and a connecting strength is improved. The eyelash stalk 2 comprises a strip-shaped stalk body 201 adhered to the false eyelash body 1, and a magnetic block 202 adhered to the strip-shaped stalk body 201 is magnetically connected with a magnetic strip 204 on an adhesion seat 203, which is convenient to stably connect the strip-shaped stalk body 201 to the adhesion seat 203 by using a magnetic attraction effect between the magnetic block and the magnetic strip, so that stable connection between the strip-shaped stalk body and the adhesion seat is realized, and it is convenient to quickly disassemble and assemble the strip-shaped stalk body and the adhesion seat at the same time, thus improving use convenience. Meanwhile, the adhesion seat 203 serves as a connecting part between the strip-shaped stalk body 201 and the eyeliner part, so that the stable wearing of the false eyelash is realized. A water-dipping glue layer 205 is arranged on a back face of the adhesion seat 203 to form an adhesion face on the adhesion seat 203, which ensures stable connection to the eyeliner part, thus achieving the purpose of stable wearing. When the false eyelash body 1 needs to be worn, the adhesion seat 203 is held by a hand, some water is applied to the adhesion face of the water-dipping glue layer 205 to adhere the adhesion seat 203 to the eyeliner part through the water-dipping glue layer 205, and then the strip-shaped stalk body 201 at the root of the false eyelash body 1 is clamped with tweezers to be adhered to the magnetic strip 204 of the adhesion base 203, so as to finish matching with the false eyelash. When applying water, clean water is applied, it is necessary to apply the water to the adhesion face of the water-dipping glue layer 205, and preferably, a cotton swab is dipped in the water and then used to apply the water. When adhering the adhesion seat, a middle portion of the adhesion seat 203 is gently pressed first to stably adhere the adhesion seat 203 to the eyeliner part, and then two sides of the adhesion seat are pressed until the adhesion seat is completely adhered, which is easy and convenient.

As shown in FIG. 2 and FIG. 3, in some embodiments, the magnetic blocks 202 are fixedly adhered to the strip-shaped stalk body 201 and distributed at equal intervals, so that the magnetic block 202 is stably mounted on the strip-shaped stalk body 201, and the magnetic block 202 is prevented from falling off during use, thus realizing stable use. The magnetic block 202 is matched with the magnetic strip 204, which is convenient to stably connect the strip-shaped stalk body 201 to the adhesion seat 203, thus achieving the purpose of stable wearing. The magnetic strip 204 is embedded in an arc-shaped groove formed in the adhesion seat 203, and the magnetic strip 204 is arc-shaped and matched with the strip-shaped stalk body 201, which ensures better fitting between the magnetic strip and the strip-shaped stalk body during connection, so that connection stability is improved. An adhesion glue tape 206 is coated in a recess formed in the back face of the adhesion seat 203, and the water-dipping glue layer 205 is fixedly connected to the adhesion seat 203 through the adhesion glue tape 206, which ensures that the water-dipping glue layer 205 is stably connected to the adhesion seat 203, so that the adhesion seat 203 is stably adhered to the eyeliner part during use, thus achieving the purpose of stable wearing.

Second Embodiment

Figure 4:
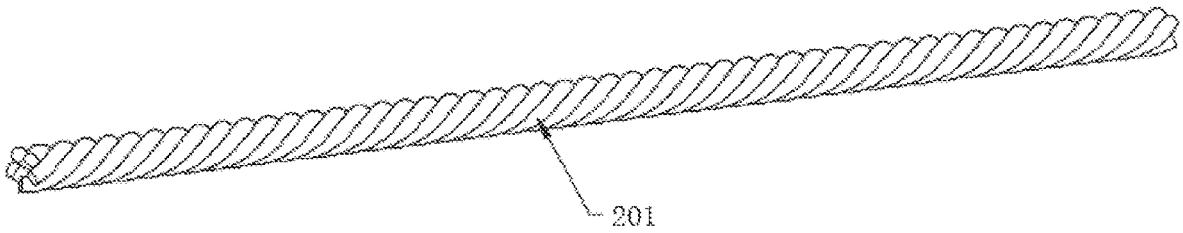
FIG. 4 is a schematic structural diagram of a strip-shaped stalk body in Second Embodiment of the application.

As shown in FIG. 1, FIG. 3 and FIG. 4, compared with First Embodiment, this embodiment serves as another implementation of the application: two strip-shaped stalk bodies 201 comprising a thicker one and a thinner one are adhered at the root of the false eyelash body 1, and in addition, the eyelash stalk may also be composed of a plurality of stalk bodies, wherein the thinner strip-shaped stalk body 201 is formed by twisting a plurality of threads with each other, and a strip with magnetism is arranged in a core of a combination of the plurality of threads twisted, which is convenient for joint use under matching with the magnetic strip 204 on the adhesion seat 203, so that the strip-shaped stalk body is stably connected to the magnetic strip, thus achieving the purpose of smooth wearing.

Finally, it should be noted that: the above are only the preferred embodiments of the application, and the preferred embodiments are not intended to limit the application. Although the application is described in detail with reference to the above embodiments, those skilled in the art may still modify the technical solutions recorded in the above embodiments, or make equivalent substitutions to some of the technical features. Any modification, equivalent substitution, improvement, and the like made within the spirit and principle of the application should be included in the scope of protection of the application.

We claim:

1. A false eyelash with multiple stalks on the same side, comprising a false eyelash body (1) and an eyelash stalk (2), wherein the eyelash stalk (2) is arc-shaped as a whole, a root of the false eyelash body (1) is adhered to the eyelash stalk (2) by glue, the eyelash stalk (2) comprises a strip-shaped stalk body (201) adhered to the false eyelash body (1), a magnetic block (202) adhered to the strip-shaped stalk body (201) is magnetically connected with a magnetic strip (204) on an adhesion seat (203), and a water-dipping glue layer (205) is arranged on a back face of the adhesion seat (203);

wherein the magnetic blocks (202) are fixedly adhered to the strip-shaped stalk body (201) and distributed at equal intervals, the magnetic block (202) is matched with the magnetic strip (204), the magnetic strip (204) is embedded in an arc-shaped groove formed in the adhesion seat (203), and the magnetic strip (204) is arc-shaped and matched with the strip-shaped stalk body (201); and wherein an adhesion glue tape (206) is coated in a recess formed in the back face of the adhesion seat (203), and the water-dipping glue layer (205) is fixedly connected to the adhesion seat (203) through the adhesion glue tape (206).

2. The false eyelash with multiple stalks on the same side according to claim 1, wherein the root of the false eyelash body (1) is adhered to two eyelash stalks (2) which are parallel to each other and arranged closely.

* * * * *